United States Patent [19]

Mitchell

[11] Patent Number: 4,558,797

[45] Date of Patent: Dec. 17, 1985

[54] STORAGE UNIT MODULE

[75] Inventor: Terry L. Mitchell, Jenison, Mich.

[73] Assignee: Quest Product Development, Ltd., Grand Rapids, Mich.

[21] Appl. No.: 565,387

[22] Filed: Dec. 27, 1983

[51] Int. Cl.[4] ..... B65D 33/00

[52] U.S. Cl. ..... 220/84; 220/1.5; 220/4 F; 52/282

[58] Field of Search ..... 270/84, 1.5, 4 R, 4 F, 270/76, 77; 217/65; 52/282, 476, 656

[56] References Cited

U.S. PATENT DOCUMENTS

| | | | |
|---|---|---|---|
| 2,980,285 | 4/1961 | Parsons | 220/84 |
| 3,394,526 | 7/1968 | Engelbrecht | 52/282 X |
| 3,485,405 | 12/1969 | Dement | 52/282 X |
| 3,955,702 | 5/1976 | Lundy | 220/84 X |
| 3,989,157 | 11/1976 | Veenema | 220/84 X |
| 4,005,559 | 2/1977 | Mathou | 52/282 |
| 4,034,535 | 7/1977 | Dustmann | 52/282 X |
| 4,157,852 | 6/1979 | Zacky | 220/84 X |
| 4,271,975 | 6/1981 | Ketner et al. | 220/1.5 X |
| 4,422,558 | 12/1983 | Mittelmann et al. | 220/4 F X |

*Primary Examiner*—Steven M. Pollard

*Attorney, Agent, or Firm*—Miller, Morriss & Pappas

[57] ABSTRACT

A storage unit module in which a plurality of selectively dimensioned panels are assembled with a plurality of correspondingly dimensioned edge extrusions and with connectors having corner tie downs for assembling space enclosures amendable to size and space adjustment using the standard selected elements and permitting a wide range of panel materials gasketed for weatherproofing. Ingress and egress means are integrated into the structure as desired.

8 Claims, 13 Drawing Figures

FIG. 10
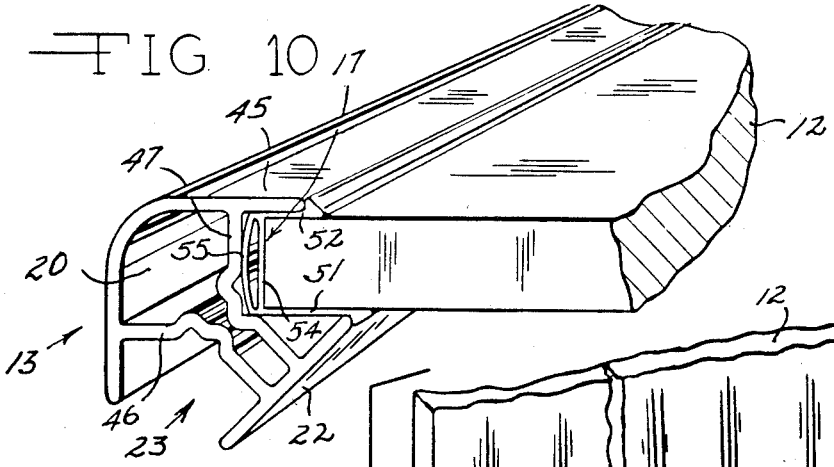
FIG. 12
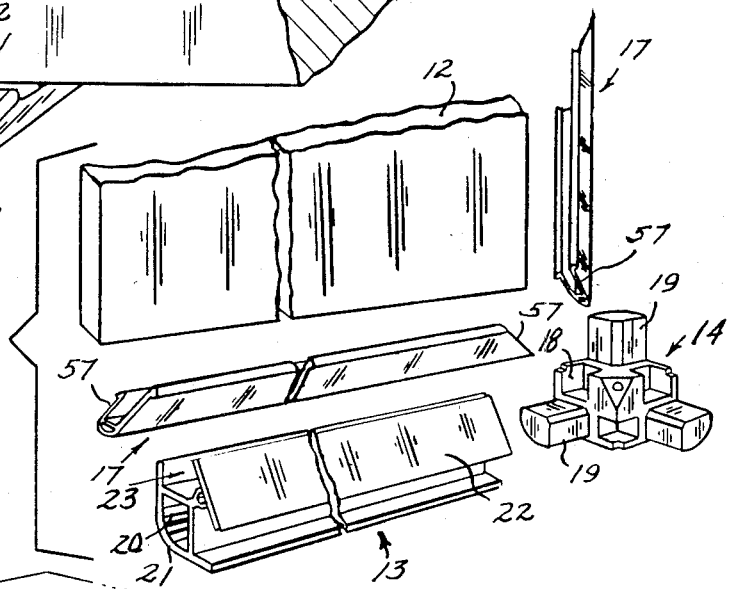
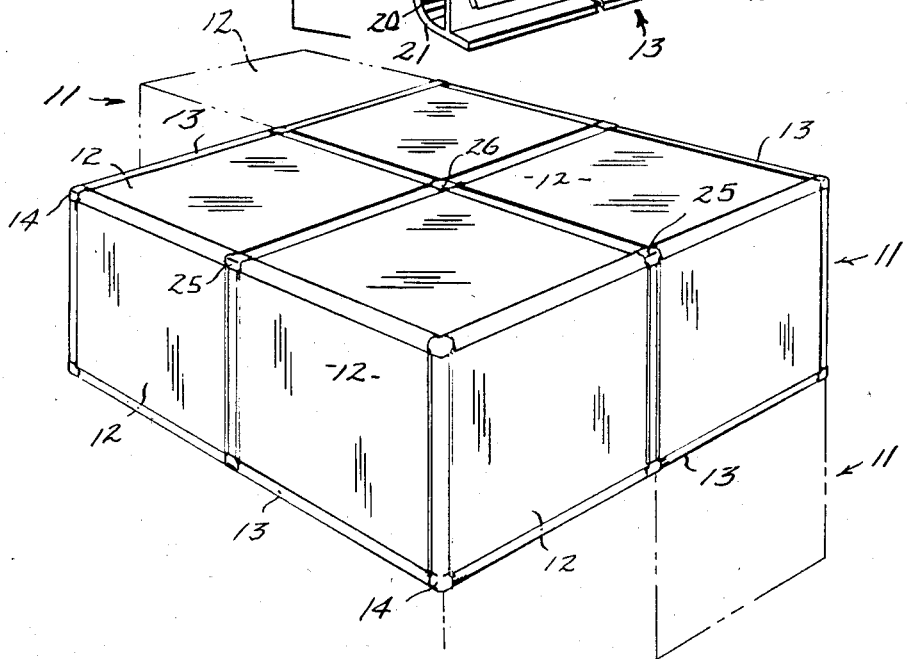
FIG. 11

STORAGE UNIT MODULE

The present invention is directed to a storage unit module in which a variety of dimensioned panels may be assembled with a plurality of edge extrusions and connectors with corner tie downs to provide space enclosures of selected volume which possess good qualities of rigidity and which enclosures are flexible as to size by the addition or subtraction of panels. The storage units are simple to assemble. They are weatherproofed by easily installed perimeter seals or gaskets, they admit of a wide range of uses from shipping structures, to rooms, tool sheds and security storage structures. The storage unit modules are assembled from elongate extruded elements which frame the panel elements, from connectors which terminally connect the ends of the extrusions at the intersections thereof; and from tie down plates and fasteners which draw the entire bundle of elements together at the connectors. The panels need only have a uniform thickness at their connection to the extrusions and to the connectors. They may be wood, plywood, metal, sheathed plastic or glass so long as they otherwise meet the end use requirements of the structure. The units are easily weatherproofed by utilizing simple extruded seals which close the perimeter of the panels and form weathertight sealing between the extrusions and connectors and the panels. The connectors are of three types and together with the margin extrusions they form sockets that are rigidified by the tie down plates which stress the panels, the extrusions and the connectors. There are corner connectors and in a rectangular unit there are four of these. There are outside edge connectors. Working together, these allow the assembly to be increased in size by units in height, width and depth. They also allow an election of particular openings as, for example, where a panel is hinged to swing out from a selected extrusion concealing the hinge and to which the hinge is secured. Alternate ingress and egress to and from the modular units may be by window and, in particular instances, by disassembly through the corner connectors as by the extension of the tie down fasteners through the connectors to allow external access to the fasteners.

Variances in the angles accommodated by the connectors adapt the modules to architectural or building adaptations for atriums, bays and the like with selected panelling such as glass.

The closest prior art known to the inventor is represented by the U.S. Pat. Nos. 2,729,355 to Donald H. Gaston for Tensionable Connection for Knockdown Articles and 2,956,705 to Paul E. Clingman for Cabinet Framework. While these two devices are at structural variance with the device herein described, they do show a corner block construction with framing strips closing on panels.

The Modular Storage Units for Bicycles or the Like of Richard A. Wolverton and Gordon J. Cooper in U.S. Pat. No. 3,967,425 and the Storage Enclosure for Bicycles, Motorcycles, or the Like of Richard W. Hartger and John M. Perry in U.S. Pat. No. 3,949,528 show temporary end usage such as would be served by the presently described structures. As the description proceeds, the substantial departures from the prior art will be apparent in the herein described modules.

Accordingly, the principal object of the present invention is to provide a simple, easily put together modular unit storage or space enclosure structure.

Another object is to provide such a structure using compression plates for locking socket connector elements, framing struts, and panels together in a rigid construction.

Still another object is to teach a storage module with attention to security while accommodating weatherproofing, expansion in all directions of width, height and depth.

Other objects including economy, saving of materials, and maximum utilization of available space will be better appreciated with employment of a wide variety of panel materials.

GENERAL DESCRIPTION

In general, the invention is a storage unit module or space enclosure in which a plurality of wall panels have, in common, a uniform wall thickness and which are sized in height and width to provide a space enclosure. The wall panels may be wood, plywood, plastic, ceramic, metal, veneer, glass or the like. The panels are framed by a plurality of uniform cross section extrusions, the cross section of the extrusions provide elongate parallel slots sized to receive the edges of panels, selectively, at gapped regular selected angles to each other and in gapped parallel relation and the extrusions include a wraparound flange defining an elongate tubular enclosure on one side of the extrusions and a flat flange on another side of the extrusions in a forty-five degree planar relation to the wraparound flange. Connector elements which have extensions that mate with the tubular enclosures in the extrusion are provided and the connectors are recessed in plural angle directions and the recesses have a width to receive the panels and conceal the corners of the panels. Also included are corner tie plates which are fasteners that extend into the connectors and impinge against all adjacent of the panels so that upon tensioning the fasteners, the storage unit of panels, extrusions, connectors and plates are drawn into a rigid construction.

The connectors are of three basic types, corner connectors, outside edge connectors and inside intersection connectors allowing selected panels to extend the walls of the modular enclosure as desired. A generally U-shaped gasket having one leg longer than the other is placed on each edge of the panels and is seated in the slots of the extrusions and the web portion of the gasket is between the legs forming a double gapped cushion as a weather seal and thermal break.

At least one panel or wall of the module construction includes an opening or means of ingress and egress to the enclosure of the storage unit. Where desired, the storage units may thus be integrated with adjacent structure in whole or in part.

IN THE DRAWINGS

FIG. 1 is a partially cut away exploded perspective view of an outside right angle corner of a modular storage unit in accord with the present invention.

FIG. 2 is a partially cut away exploded perspective view of one side and the top of a modular storage unit in accord with the present invention with the panels cut in section in a plane parallel to the ends of the edge extrusions to indicate the variant panel materials and showing sides and top with plural parallel panels joined together by reversed extruded edge struts identical to the edge extruded struts and providing a flat external appearance.

Figure 7B:
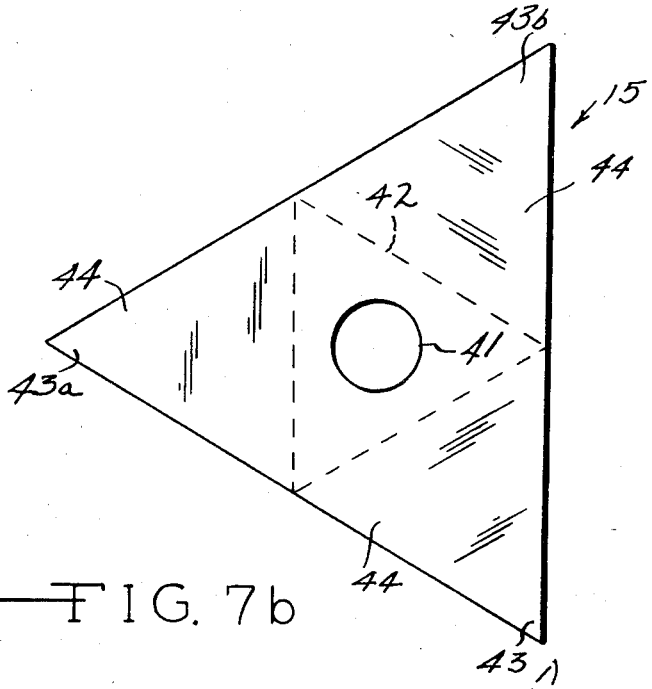
Figure 7A:
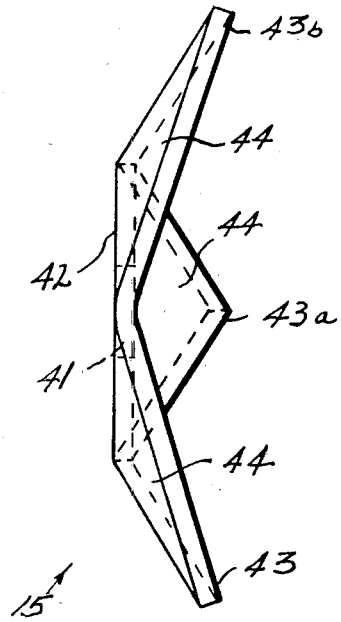

FIG. 7*a* is an end elevation view of a triangular corner tie plate having a centrally located opening therethrough and bent from a central equilateral planar platform to form three depending legs.

FIG. 7*b* is a top plan view of the triangular corner tie plate in FIG. 7*a* and indicating the perforated planar platform in respect to the downturned legs.

Figure 8:
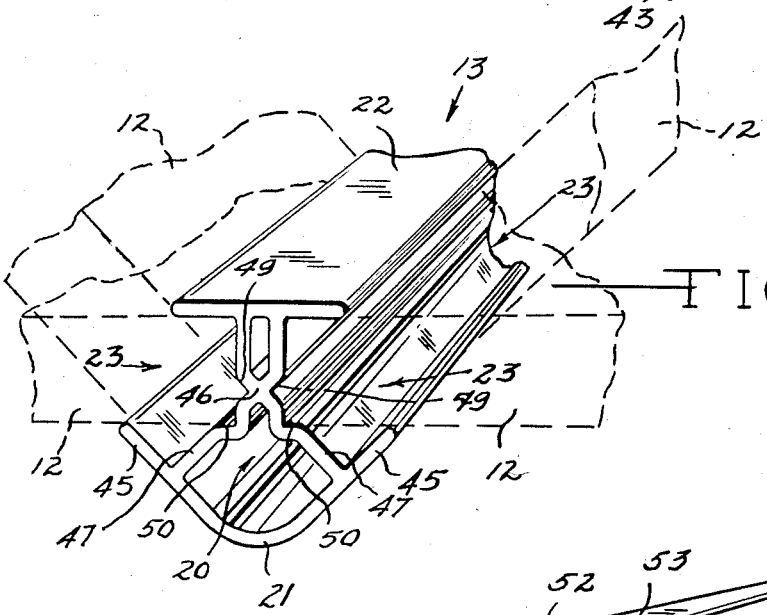

FIG. 8 is a fragmental perspective view from the end of an extrusion forming the rigid struts of the present invention and optionally useable as an outside edge or a flat plane intermediate outside surface for coplanar panels.

Figure 9:
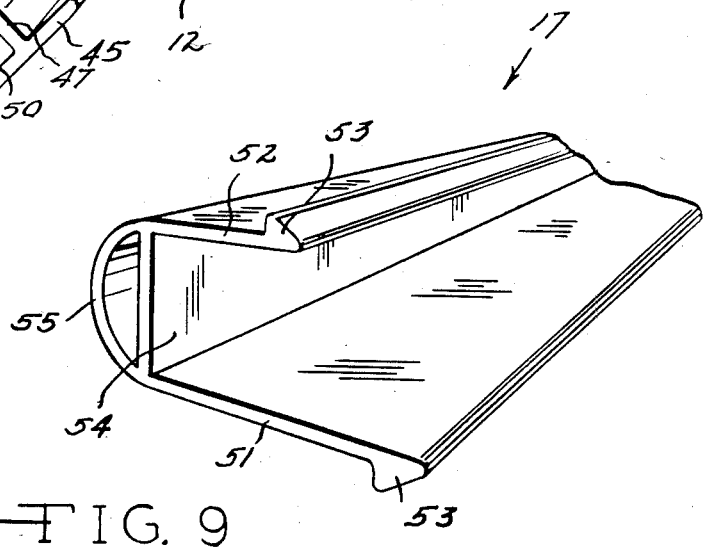

FIG. 9 is a fragmental perspective view of a continuously extruded seal useable on all edges of panels and embraced by the extruded rigid struts and the connectors.

FIG. 10 is a fragmental perspective view of a rigid extruded strut in use as an outside edge of a modular storage structure and indicating the receipt by the strut of a panel in which the edge is encased in the extruded seal impinging on the flanges of the strut extrusion.

FIG. 11 is a perspective view of a plurality of modules under the present invention and joined to create an expanded space enclosure module as desired.

FIG. 12 is an exploded perspective view illuminating the assembly of panels to seals to struts to connectors, and specifically a corner connector accommodating three panels, three struts and requisite gaskets, mitred at their ends, as shown, to close against each other.

SPECIFIC DESCRIPTION

Figure 1:
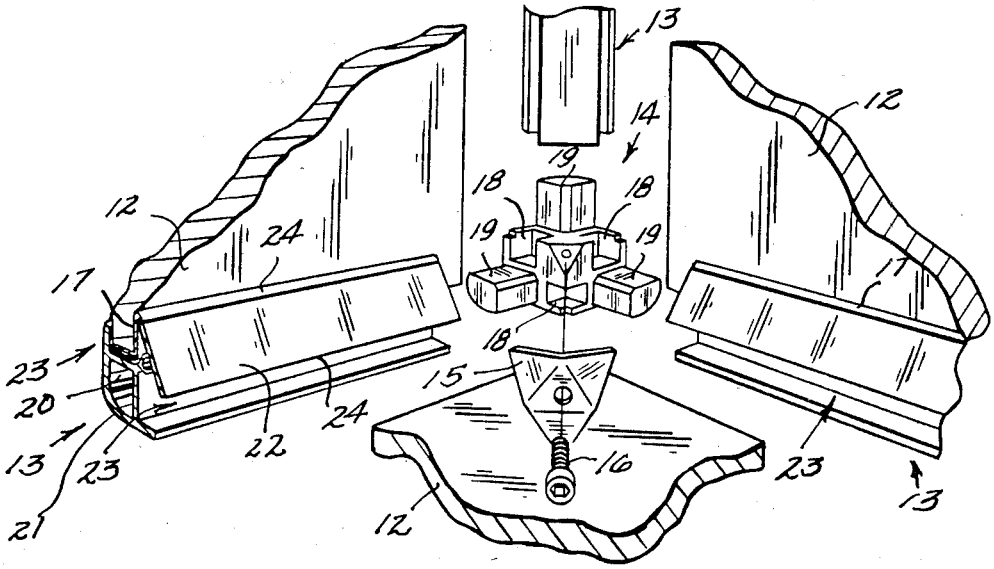

Referring to the drawings and with first specificity to the FIG. 1, the basic corner construction is shown with the plural panels 12, the edge extrusions or panel framing edge struts 13, and the corner connector 14 along with the compression plate 15 with fastener 16 to clearly express the knock-down and assembly simplicity of the storage unit module of the present invention. Each corner includes the construction expressed in FIG. 1 and a gasket 17 which, as will be seen, is mitred at the ends is available for provision of a weather seal or thermal break. Rigidification of the structure occurs upon tightening the compression plates 15 at the corner connectors or corner blocks 14. As will be appreciated, the thickness dimensions of the panels 12 establish the panel dimension of the panel pockets 18 in the corner connector 14 where it receives the corners of the intersection planes of the panels 12. The corner connector 14 also includes three protrusions or extensions 19 which, as will be seen, are configured for mating insertion in the elongate tubular enclosures 20 in the extrusions 13 to establish, upon assembly with the extrusions 13, an aligned and rigidly oriented relationship between adjacent panels 12 and the extrusions 13 framing the edges of the panels 12. The extrusions 13 include an arcuate wraparound edge or flange 21 and an integral planar beveled plate-like surface 22 and integral webbing to form a pair of panel receiving elongate slots 23 running the length of the extrusions 13. The inner edges of the slots 23, as viewed in FIG. 1, are formed by the elongate edges 24 of the planar bevel surface 22. As viewed in FIG. 1, the arcuate flange 21 is an outer flange and the bevel plate 22 is an inner facing flange. As will be seen, the flange 21 and plate 22 are reversed in some installations where the extrusions 13 do not abut an outer edge. The panels 12 extend slightly beyond the ends of the edge extrusions or struts 13 to rest in pockets at the connectors and in the extruded edge struts 13 of adjacent structure.

As will be appreciated, the panels 12 may be made of wood, plastic, metal, glass, insulating or ceramic materials and varying laminations thereof and these are susceptible of decorative ornamentation and variation from panel to panel. Variants may include differences in opacity, translucity, and transparency, as well as in color and texture. The material of the panels 12 may have sun screening capability and possess various degrees of thermal reflecting absorption and adsorption depending largely upon the intended use and contents of the enclosure formed by use of the modular unit storage, as described.

Figure 2:
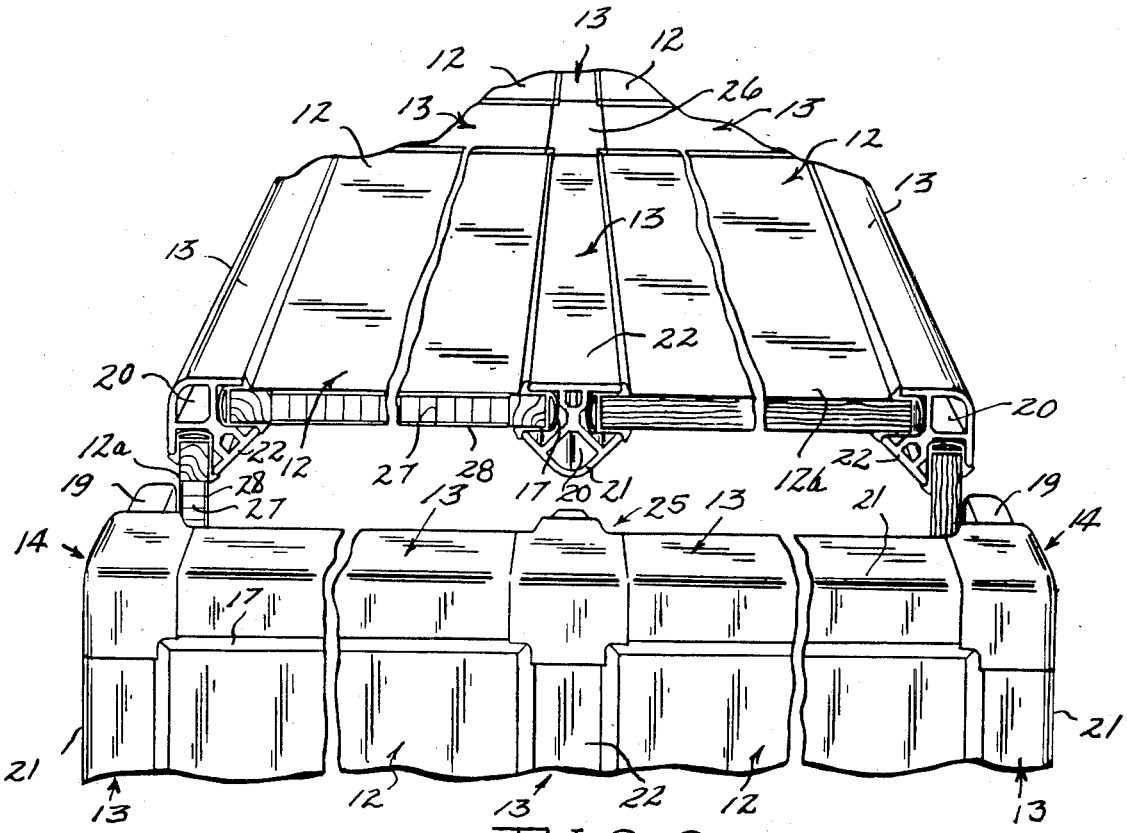

While the FIG. 1 proposes a single module size related to panels 12 having common size, the FIG. 2 indicates the expansion of the module in a most simplistic way to expand storage space as desired in all directions in multiples with common panel sizing, the repeated use of corner connectors 14 and edge extrusions 13 and with edge connectors 25 and intermediate connectors 26, as shown, in combination with the corner connectors 14 and their respective compression plates 15. The end edges of the panels 12 and gaskets 17 extend beyond the ends of the edge extrusions or struts 13 but are cut away to reveal the various panel possibilities. The panel 12*a* is seen as a wood framed composite with a cellular core material 27 with shin 28 in metal or plastic. The panel 12*b* is a wood veneer with glued laminations 29.

Figure 3:
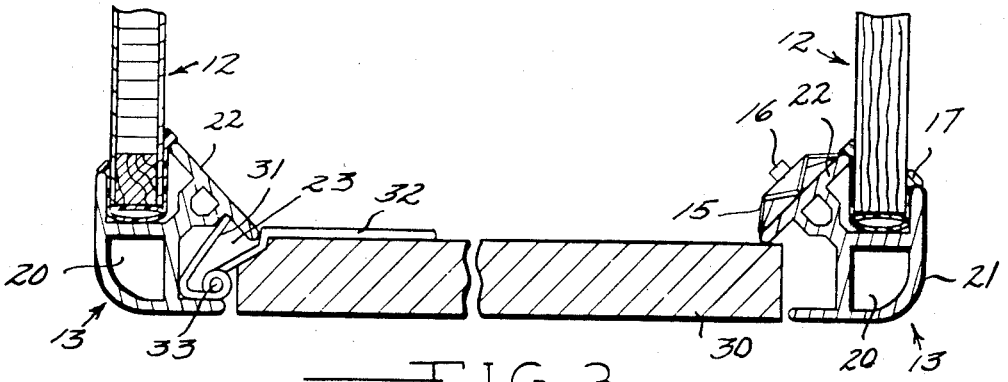
FIG. 3 is a top plan cross sectional view taken through two separated end panels and showing the corner post formed from the extruded struts supporting the end panels and with the extruded struts providing framing and support for the door and hinges.

FIG. 3 indicates the inclusion of a door or window panel 30 hinged to an edge extrusion or strut 13. The hinge elements 31 and 32 on pintle 33 provide a sturdy hinge support for the door 30 and with the hinge element 31 being pressed into the panel slot 23 of the extrusion 13. The other three edges of the door 30 close against the gasket edges of beveled support surface 22 of the extrusion 13. The compression plate 15 can be seen and bearing against the beveled plane surface 22. Fastening hardware as hasps, locks and weatherproofing are not shown.

Figure 4:
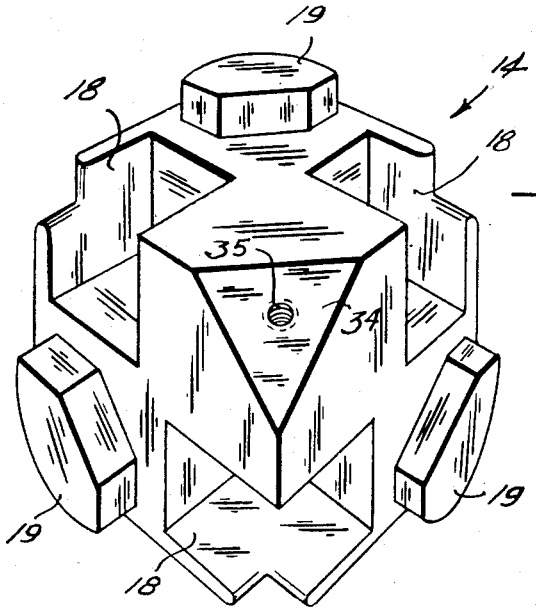
FIG. 4 is a perspective view of a corner connector in accord with the present invention and indicating the panel grooving to serve three panels in variant planes, the extensions are in three directions and providing a male part of a socket against the ends of the extrusions or struts, and the truncation which provides a right angle surface for a threaded fastener opening.

FIG. 4 shows the corner connector or block 14 with the extensions 19, the panel pockets 18 into which the corners of panels 12 extend and rest and in which the curvature of the extensions 19 are appreciated as providing a slip fit for insertion in the elongate openings 20 in the extrusions 13. The truncated inner face 34 of the corner connector or block 14 is seen to include a threaded opening transversely into the connector 14. Where it is desired that the structures be disassembled from the inside, the threaded opening 35 is a blind hole with access for the fastener 16. Where disassembly is sought externally, then the fastener 16 enters a through-opening 35 allowing the fastener 16 to be manipulated as by an Allen type head provided in the threaded portion of the fastener 16. The rounded extension corner contour of the corner connector 14 is best seen in FIG. 2 but the rounded external portion fairs into planal surfaces 36 which match with the planal transition surfaces of the extrusions 13 and close against supported panels 12 and gasketing 17. The corner connectors or blocks 14 are molded in integral form, as shown, from plastic or metal such as brass, aluminum, bronze, iron, steel or the like.

Figure 5:
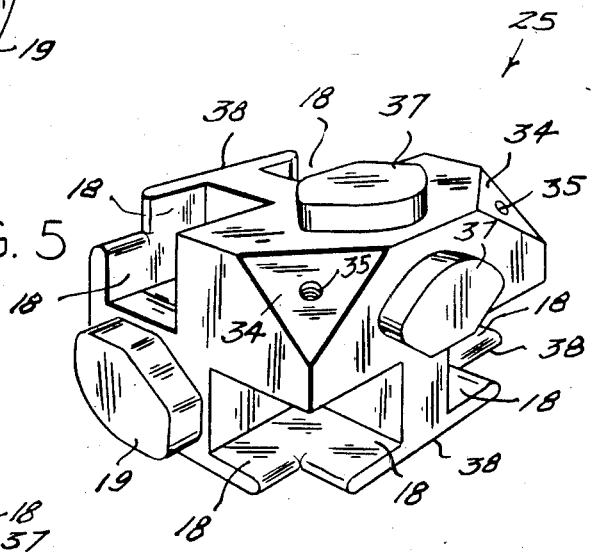
FIG. 5 is a perspective view of an outside edge connector and adapted to receive four strut extrusions and four panels.

FIG. 5 shows an outside edge connector 25 and having four panel pockets 18 and having extensions or protuberances 19 as in the corner connectors 14 (one furthest from view is not visible but extends from the opposite side from the visible extension 19). In this edge connector 25, the extensions 37 will be appreciated as reversed in orientation from the extrusions 19 so as to permit the reversal of the extrusions 13 so that the planar bevel surfaces 22 match the flat surfaces 38 of the edge connector 25 and the curved flange 21 then faces inwardly as in FIG. 2. In this connector 25 the truncated faces 34 are two in number, as seen, and threaded fastener openings 35 are transversely passed through the two faces 34 as in the construction in FIG. 4 and for the same reasons to accommodate the compression plates 15 and fasteners 16. The threaded opening 35 may be, selectively, blind or through. The edge connector 25 is integrally formed by materials and methods of manufacture referred to in respect to the connector 14 are applicable. It will be understood that in all of the connectors 14, 25 and 26 that composite constructions of each may be utilized and then the composite parts are combined to appear as in FIGS. 4, 5 and 6.

Figure 6:
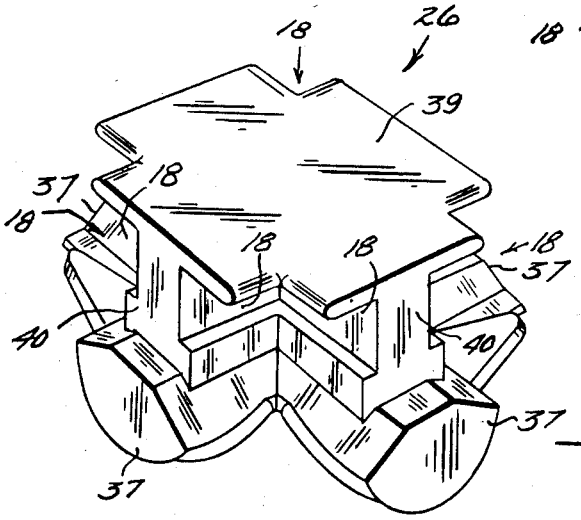
FIG. 6 is a perspective view of an inside intersection connector in accord with the present invention and adapted to receive four strut extrusions radiating therefrom and four coplanar panels.

In FIG. 6 the intermediate inside connector 26 is best shown. Connector 26 includes four corner panel pockets 18 and the outer surface 39 which is planar or flat while the converging inner surfaces are curvalinear with the extension 37 projecting radially therefrom in common planal relation whereby the extrusions 13 receive the projecting extensions 37 and abut the surfaces 40.

By reference to the FIGS. 7*a* and 7*b* the compression plates 15 are preferably metal as, for example, in a spring steel and formed from a single equilateral triangular flat piece of stock as in FIG. 7*b* and centrally penetrated by an opening 41. Then, registering on the opening 41 the blank is held at 42 (equilateral triangle at the phantom lines indicated) and the radiating points of the blank 43, 43*a* and 43*b* are lifted or depressed in equal planar portions 44. Then, as will be appreciated, the compression plates 15 are placed on the truncated surfaces 34 of FIGS. 4 and 5 as indicated in FIG. 1 and are fastened to the respective connectors 14 and 25 by the fasteners 16. The tips 43, 43*a* and 43*b* of the plate 15 press together the panels 12, connectors 14, 25 and 26 and extruded struts or edges 13 to provide a rigid construction. The compression plates 15 are like crowns resting in an inverted position against surfaces 22 of extrusion 13 and, upon tightening, draw all contacted parts into a firm, whole assembly.

In the FIG. 8 the edge extrusions 13 can best be understood and the regular cross section extrusion configuration is best shown. The extrusions are of length to suit the edges of the panels 12 stopping somewhat short of the ends of the panel edges (FIG. 1). The extrusions 13 have curvalinear regular elongate nosing on one side regarded as an external curvalinear flange 21 and faired into planar wing portions 45 of the flange 21. Opposite the rounded flange 21 is the elongate beveled plate-like surface 22 and transverse to the plane of symmetry through the surface 22. The surfaces 21 and 22 are integrally connected by the integral web 46. The web 46 is bifurcated and the bifurcations 47 form, with the rounded flange 21, an elongate tubular opening 20 which selectively accepts the extensions 19 and 37 of the connectors 14, 25 and 26 so that the extrusions 13 accommodate panels 12 in selected of two planes on each side, as indicated in phantom line in FIG. 8. The bifurcations 48 in the web 46 support the planar surface 22 and the shoulders at 49 and 50 provide pocketing for the edges of the panels in the indicated positions of the panels 12. As will be appreciated, the elongate slots 23 are thus defined by the edges 24 of the surface 22 and the wings 45 in two positions depending upon usage of the extrusions 12 where the curved nosing 21 forms an outer edge or the planar surface 22 forms an outer surface with the nosing 21 inverted.

In FIG. 9 the elongate gasket 17 is shown which is positioned to frame the edges of the panels 12 and ready to be press fitted into the elongate slots 23 as between the wings 45 and edges 24 of planar surface 22. These gaskets 17 are integrally formed of a generally U-shaped configuration in cross section with one of the arms 51 thereof being longer than the arm 52, both arms terminate at the top in elongate ridges 53 having a uniform cross section. A web 54 of gasket material is transverse to the legs 51 and 52 and forms a floor-like portion. Beneath that floor of web 54 is an arcuate web portion 55 which integrally connects to the legs 51 and 52 and to the web 54. The gasket 17 is formed of resilient and weather-resistant material such as rubber, vinyl or Neoprene-like material. As will be seen, the gaskets 17 extend the length of the panel edges and encase those edges in a weathertight installation when properly assembled and suitably mitred.

In the FIG. 10 a typical assembled relation of the gasket 17 is shown in one of the slots 23 in the edge extrusion 13. The long leg 51 of the gasket 17 bears against beveled plate-like surface 22 with an overlap formed by the elongate ridge 53. The wing portions 45 similarly close on the short leg 52 of the gasket 17. The floor web 54 and the outer arcuate web portion 55 of the gasket 17 bottom against the integral web 46 and 47 of the extrusion 13 between surface 22 and arcuate nose or flanging 21, as shown. In this view, no effort is made to indicate that the panels 12 are extended beyond the ends of the extrusions 13 and that the ends of the gaskets 17 are then mitred back from the corners of the panels 12 at 45 degrees, as will be seen. The extent of the panel overhang, as shown, is an amount corresponding to the depth of the panel receiving pockets 18. In the FIG. 10 the weathertight seal is best appreciated.

The FIG. 11 schematically indicates the extension of the modules or units 11 and the extreme flexibility to enlarge or diminish the total enclosed space. While shown to be units 11 generally square, and hence producing cubic enclosures, the invention contemplates rectangular panel configurations where each module 11 may include, say, varying ratios of panel height to width. This will be understood especially as accommodating closures for ingress and egress, as in FIG. 3, which may not embrace the entire wall surface of a panel 12. In raising or adding the phantom units 11, the edge connector 25 may require substitution of connector 26 where a coplanar relation is sought.

FIG. 12 is an exploded partial perspective view of a typical corner and indicating the connector 14 for receiving the panel 12 with the mitred gaskets 17 in the pocket 18 and the gaskets 17 position in the elongate slots 23 of the edge extrusion 13 to form the corner which is ultimately held together by the compression plates 15 (FIG. 1) and the mitres 57 of the gaskets 17 close against each other at the ends and are concealed beneath the shroud formed by the walls of the pockets 18 upon assembly. The extensions or protuberances 19 from the corner connectors 14 enter the elongate tubular openings 20 in extrusions 13 and the openings 20 match the profile of the protuberances 19. The ends of the extrusions 13 abut the connectors 15, as can be seen. This assembly is repeated in connecting plural panels 12 to the edge connectors 25 and inside connectors 26.

In manufacture of the components making possible the storage unit modules 11, the connectors are easily precision cast on a highly economical basis. The gaskets are formed from easily extruded, low cost vinyl in selected colors and ornamentation. The edge extrusions 13 are extrusions of relatively rigid material in plastic, metal or ceramic and the panels are structurally available pre-form materials as elsewhere indicated and generally available in the marketplace as plywood, glass, plastic or laminates including ceramics or the like and with or without insulating cores. The panels are dimensional in multiples of height and width as well as the extruded edges. These elements ship nicely in a condensed knockdown fashion and may be kit retailed in modules or bulk sold at installation outlets and centers for assembly on the job. Where variances in right angle relationships or parallel relationships in panels is sought, this can be accommodated by facile and obvious changes in the connectors and compression elements as in accommodation to 30 degree, 45 degree, and 60 degree relationships to provide peak roofs and the like.

The units 11 have proved valuable in storage of goods and merchandise as in temporary or adjunct living or working space. Excellent tool cribs and office shelters are quickly assembled.

Having thus described my invention and especially the preferred embodiment thereof, those skilled in the art will quickly grasp improvements, changes and modifications thereof and such improvements, changes and modifications are intended to be included herein, limited only by the spirit of the invention as expressed in the allowed claims of my application.

I claim:

1. A storage unit module comprising:

a plurality of wall panels having a uniform thickness and sized in height and width to provide space enclosures;

a plurality of uniform cross section extrusions, the cross section forming elongate parallel slots sized to receive edges of said panels selectively at gapped regular angles to each other and in gapped parallel relation and said extrusion including a wraparound flange defining an elongate tubular enclosure on one side and a flat flange on another side of said extrusion in a forty-five degree planar relation to said wraparound flange;

connector elements having extensions mating with said tubular enclosures in the ends of said extrusions and said connectors recessed in plural angle directions, said connector recesses having a width to receive said panels and conceal the corners thereof; and corner tie plates each having a single fastener extendable into said connectors and said plates impinging against all adjacent of said panels whereby upon tensioning said fasteners said storage unit is drawn into a rigid construction.

2. In the combination of claim 1 wherein said connectors are corner connectors, outside edge connectors and inside intersection connectors.

3. In the combination construction of claim 1 including gaskets on the edges of said panels, said gaskets having a generally U-shaped cross section, one of the legs thereof being longer than the other of said legs and the intermediate web between said legs defining a double gapped cushion.

4. In the combination construction of claim 1 wherein at least one of said panels provides a means of ingress and egress to said storage unit.

5. In the combination of claim 1 wherein said panels and said extrusions are sized to correspond with next adjacent of said panels and wherein said extrusions abut said connectors.

6. A storage unit comprising one or more modules and expandable in height, width and depth comprising:

a plurality of rigid panels arranged to form rectangular enclosures of top, bottom, ends and sides and in which each of said top, bottom, ends, and sides are selectively enlarged by utilization of plural adjacent parallel of said panels in forming said enclosure;

a plurality of uniform cross section extrusions, the cross section forming elongate parallel slots sized to receive said panels selectively at gapped right angles to each other and in gapped parallel relation and said extrusions including a wraparound flange defining an elongate tubular enclosure on one side and a flat flange on another side of said extrusion in a forty-five degree planar relation to said wraparound flange, the extensions of said flanges forming panel support arms;

connector elements at corners, outside edges and inside intersections, said connector elements having extensions which mate and socket in said tubular enclosures in the ends of adjacent said extrusions and said connectors recessed in plural directions, said connector recesses receiving said panels and concealing the corners thereof and in abutting relation against connected extrusions and in flush relation to said flanges of said extrusions;

extruded U-shaped seals over the edges of said panels and extendable into the slots of said extrusions and the recesses of said connectors, the upstanding legs of said seals having a lip curling over said flanges of said extrusion and corresponding surfaces of said connectors; and tie down plates secured to each connector and each tie down including a fastener and said tie down plates extending to impinge on adjacent of said panels and said fastener passing through said tie down plates and tensioned to draw together said connectors and adjacent panels.

7. In the combination of claim 6 and where at least one of said panels includes an opening therethrough providing access to the interior of said storage unit.

8. In the combination of claim 6 wherein selected of said fasteners are accessible through selected of said connectors from the exterior of said connectors.

* * * * *